US012644371B2

(12) United States Patent
Gibson, Jr.

(10) Patent No.: US 12,644,371 B2
(45) Date of Patent: Jun. 2, 2026

(54) DATA-DRIVEN FEATURE ENGINEERING AND MACHINE LEARNING FOR ANALYSIS OF DISTRIBUTED SENSING DATA

(71) Applicant: Halliburton Energy Services, Inc., Houston, TX (US)

(72) Inventor: Richard Lloyd Gibson, Jr., Littleton, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 696 days.

(21) Appl. No.: 17/849,301

(22) Filed: Jun. 24, 2022

(65) Prior Publication Data

US 2023/0417136 A1 Dec. 28, 2023

(51) Int. Cl.

| | |
|---|---|
| ***E21B 47/002*** | (2012.01) |
| ***E21B 43/26*** | (2006.01) |
| ***E21B 47/04*** | (2012.01) |

(52) U.S. Cl.

CPC ..... *E21B 47/0025* (2020.05); *E21B 43/26* (2013.01); *E21B 47/04* (2013.01)

(58) Field of Classification Search

CPC ..... E21B 43/26; E21B 47/0025; E21B 47/04; E21B 47/06; E21B 47/107

See application file for complete search history.

(56) References Cited

U.S. PATENT DOCUMENTS

| | | | |
|---|---|---|---|
| 6,216,544 | B1 | 4/2001 | Adachi et al. |
| 8,204,693 | B2 | 6/2012 | Briers et al. |
| 2015/0377667 | A1 | 12/2015 | Ahmad et al. |
| 2017/0275986 | A1 | 9/2017 | Nunes et al. |
| 2018/0003032 | A1 | 1/2018 | Donzier et al. |
| 2018/0073904 | A1 | 3/2018 | Parolini et al. |
| 2018/0202264 | A1 | 7/2018 | Sarduy et al. |
| 2018/0356275 | A1 | 12/2018 | Zhao et al. |
| 2019/0219716 | A1 | 7/2019 | O'Toole et al. |
| 2019/0242735 | A1 | 8/2019 | Garoon et al. |
| 2019/0324166 | A1 | 10/2019 | Lolla et al. |

(Continued)

FOREIGN PATENT DOCUMENTS

| | | |
|---|---|---|
| CN | 113341459 | 9/2021 |
| CN | 114371504 | 4/2022 |

(Continued)

OTHER PUBLICATIONS

"Distributed acoustic sensing", Wikipedia, The Free Encyclopedia. Wikipedia, The Free Encyclopedia, Jul. 5, 2022.) (Year: 2022), Jul. 5, 2022, 4 pages.

(Continued)

*Primary Examiner* — Yoshihisa Ishizuka

(74) *Attorney, Agent, or Firm* — DeLizio, Peacock, Lewin & Guerra LLP

(57) ABSTRACT

Provided, in one aspect, is a method comprising receiving data of measurements from a distributed sensing system having sensors distributed along different depths of a wellbore formed in a subsurface formation; and performing signal processing of the data to output a number of modes, wherein each mode includes a subset of the data that quantifies behavior of at least one of a fluid in the subsurface formation and a rock in the subsurface formation on a different combination of locations in the wellbore and timing of the measurements.

20 Claims, 8 Drawing Sheets

(56) References Cited

U.S. PATENT DOCUMENTS

| | | | | |
|---|---|---|---|---|
| 2019/0338621 | A1 | 11/2019 | Jin et al. | |
| 2020/0025963 | A1* | 1/2020 | Ghahfarokhi | E21B 47/135 |
| 2020/0278465 | A1 | 9/2020 | Salman et al. | |
| 2020/0309981 | A1* | 10/2020 | Ang | E21B 47/107 |
| 2020/0319360 | A1 | 10/2020 | Horne | |
| 2021/0010839 | A1 | 1/2021 | Garoon et al. | |
| 2021/0018655 | A1 | 1/2021 | Sun et al. | |
| 2021/0025740 | A1 | 1/2021 | Quin et al. | |
| 2021/0047916 | A1 | 2/2021 | Thiruvenkatanathan et al. | |
| 2021/0088476 | A1 | 3/2021 | Abdelfattah et al. | |
| 2021/0089905 | A1 | 3/2021 | Olsen et al. | |
| 2021/0123334 | A1 | 4/2021 | Madasu et al. | |
| 2021/0318457 | A1 | 10/2021 | Zheng et al. | |
| 2021/0381865 | A1 | 12/2021 | Ellison | |
| 2021/0382194 | A1 | 12/2021 | Mukhtarov et al. | |
| 2021/0389486 | A1 | 12/2021 | Thiruvenkatanathan | |
| 2022/0034220 | A1 | 2/2022 | Madasu et al. | |
| 2022/0065085 | A1 | 3/2022 | Shetty et al. | |
| 2024/0027640 | A1 | 1/2024 | Schaeffer | |
| 2024/0102835 | A1 | 3/2024 | Jaaskelainen et al. | |
| 2024/0118118 | A1 | 4/2024 | Drew et al. | |

FOREIGN PATENT DOCUMENTS

| | | |
|---|---|---|
| EP | 1250513 | 4/2005 |
| EP | 3800323 | 4/2021 |
| GB | 2570260 | 4/2022 |
| WO | 2021133864 | 7/2021 |
| WO | 2023249663 | 12/2023 |
| WO | 2024019761 | 1/2024 |
| WO | 2024072454 | 4/2024 |
| WO | 2024076374 | 4/2024 |

OTHER PUBLICATIONS

"U.S. Appl. No. 17/871,545 Non-Final Office Action", Oct. 15, 2024, 26 pages.

"U.S. Appl. No. 17/961,291 Non Final Office Action", Aug. 16, 2024, 17 pages.

Huot, et al., "Detection and Characterization of Microseismic Events from Fiber-Optic DAS Data Using Deep Learning", Sensors (Basel). Oct. 5, 2021;21(19):6627. doi: 10.3390/s21196627. PMID: 34640947; PMCID: PMC8512364.) (Year: 2021), Mar. 14, 2022, 27 pages.

Wamriew, et al., "Deep Neural Networks for Detection and Location of Microseismic Events and Velocity Model Inversion from Microseismic Data Acquired by Distributed Acoustic Sensing Array", Sensors (Basel). Oct. 5, 2021;21(19):6627. doi: 10.3390/s21196627. PMID: 34640947; PMCID: PMC8512364.) (Year: 2021), Oct. 5, 2021, 17 pages.

"U.S. Appl. No. 17/961,291 Final Office Action", Dec. 4, 2024, 16 pages.

"PCT Application No. PCT/US2022/077805, International Search Report and Written Opinion", Jul. 3, 2023, 9 pages.

"PCT Application No. PCT/US2022/073172, International Search Report and Written Opinion", Mar. 23, 2023, 9 pages.

"PCT Application No. PCT/US2022/074086, International Search Report and Written Opinion", Apr. 13, 2023, 10 pages.

"PCT Application No. PCT/US2022/077293, International Search Report and Written Opinion", Jun. 27, 2023, 17 pages.

Anikiev, et al., "Microseismic event location using artificial neural networks", First International Meeting for Applied Geoscience & Energy Expanded Abstracts, Sep. 1, 2021, 5 pages.

Becker, et al., "Distributed Acoustic Sensing as a Distributed Hydraulic Sensor in Fractured Bedrock", Water Sources Ressearch, vol. 56, Issue 9, Aug. 14, 2020, 10 pages.

Carpenter, "Distributed Fiber-Optic Sensing Enhances Flow Diagnostics in Gas Condensate Well", Journal of Petroleum Technology, vol. 74, Issue 3, Mar. 1, 2022, 3 pages.

Castellanos, et al., "Microseismic Event Locations using the Double-Difference Algorithm", Recorder: Official Publication of the Canadian Society of Exploration Geophysicists, vol. 38 Issue No. 03, Mar. 1, 2013, 12 pages.

Dande, et al., "Fluid Flow Rate and Perforation Cluster Efficiency Using Fiber-Optics Das Data", 55th U.S. Rock Mechanics/Geomechanics Symposium Jun. 18-25, 2021, Jun. 18, 2021, 6 pages.

Drew, et al., "Oil and Gas Well Multi-Phase Fluid Flow Monitoring With Multiple Transducers and Machine Learning", Pending U.S. Appl. No. 63/263,898, filed Nov. 11, 2021, 17 pages.

Ekechukwu, et al., "Well-Scale Demonstration of Distributed Pressure Sensing Using Fiber-Optic DAS and DTS", Scientific Reports vol. 11, Article No. 12505 (2021), Jun. 14, 2021, 18 pages.

Garcia-Ceballos, "Machine Learning Based Two-Phase Flow Monitoring Using DAS", Colorado School of Mines; 2021 Virtual Undergraduate Research Symposium; https://www.mines.edu/undergraduate-research/machine-learning-based-two-phase-flow-monitoring-using-das/, Apr. 19-23, 2021, 6 pages.

Sharma, et al., "Well-Scale Multiphase Flow Characterization and Validation Using Distributed Fiber-Optic Sensors for Gas Kick Monitoring", Optics Express vol. 28, Issue 26, Dec. 21, 2020, 15 pages.

* cited by examiner

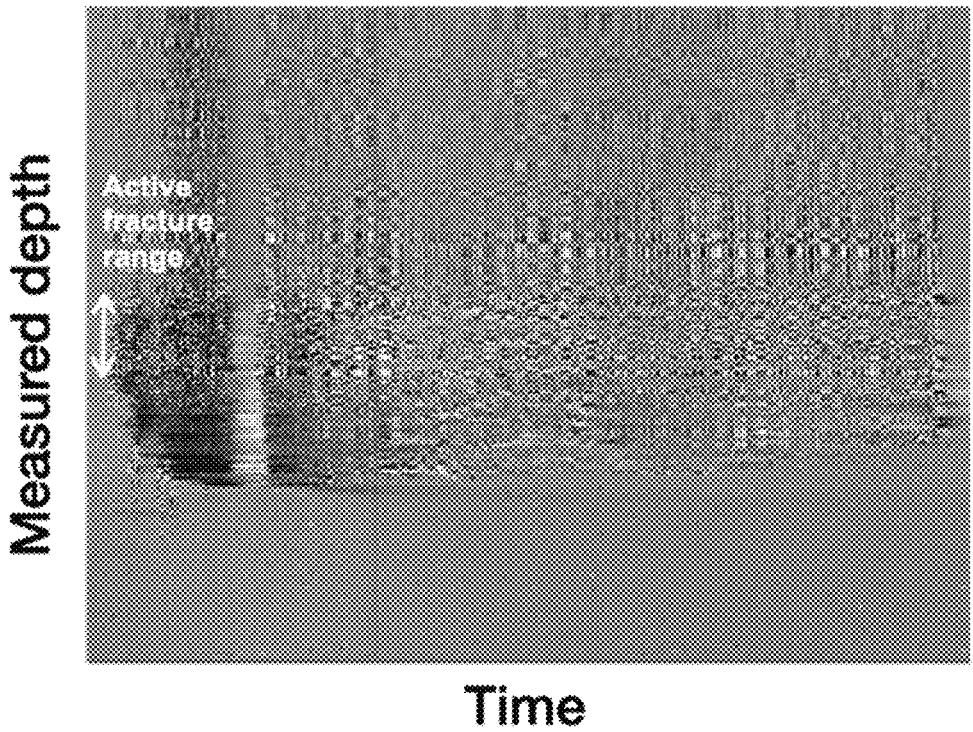
FIG. 5C
FIG. 5B
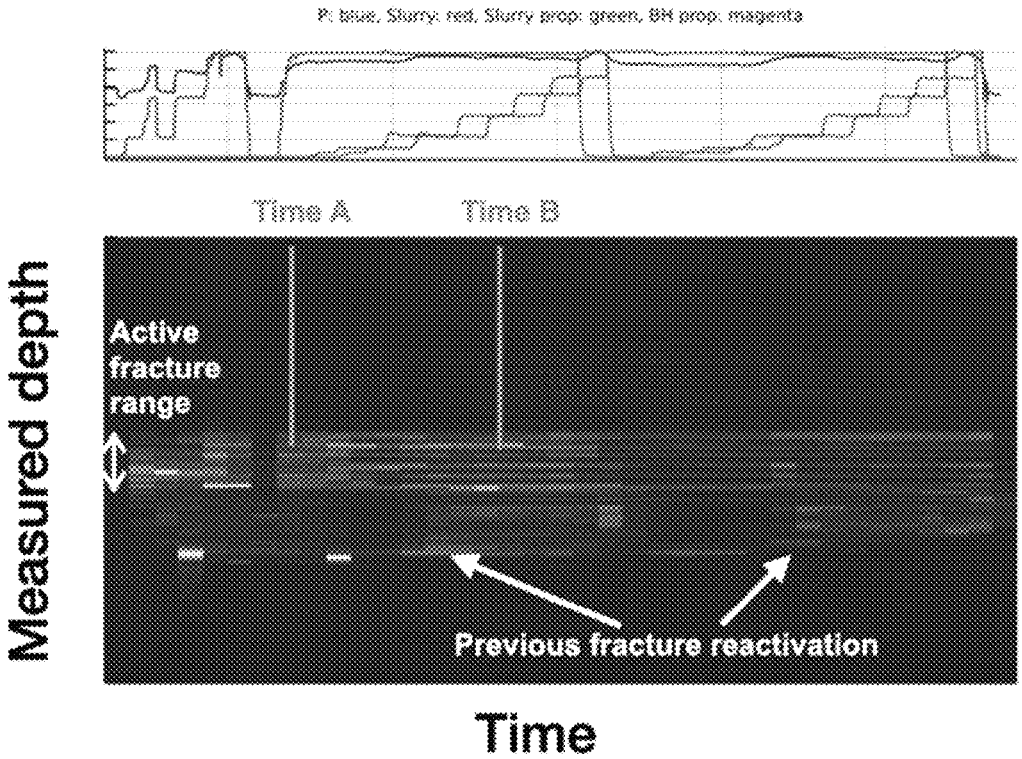
FIG. 5A

DATA-DRIVEN FEATURE ENGINEERING AND MACHINE LEARNING FOR ANALYSIS OF DISTRIBUTED SENSING DATA

BACKGROUND

Fiber optic distributed sensing methods provide the opportunity to sample strain and temperature variations with detailed sampling along the borehole and in real time. Careful analysis of the data can allow engineers and geoscientists to understand the behavior of reservoir rock, fluids, and pressure systems better, giving quantitative measures for improved management of hydrocarbon production. However, the massive data volumes make rapid analysis difficult, especially because the data are affected by physical processes occurring on a broad range of spatiotemporal scales. For example, during fracturing, acoustic signals will be generated by fracture propagation and by fluid flow, which will take place on different scales.

Measurements from a distributed sensing system may sample all of the processes taking place along a fiber optic cable, but in many cases only a subset of those processes, operating on a subset of spatiotemporal scales, are relevant for the engineering task. Current data processing schemes may be unable to isolate the relevant data features and reduce the data volume.

Current processing schemes applied for analysis of flow or fracturing may emphasize measures applied to signals from individual sensor channels. For example, frequency filtering can enhance either the low frequency strain generated by a propagating fracture system or rapid flow at high frequencies. Other measures may quantify amplitude or phase variation of signals, but all of these approaches may ignore any spatial dependence since they operate on individual channels.

BRIEF DESCRIPTION

Reference is now made to the following descriptions taken in conjunction with the accompanying drawings, in which:

FIG. 5A-5C illustrate an example of data collected from one embodiment of distributed sensing system and output from analysis performed using one embodiment of the methods disclosed herein;

DETAILED DESCRIPTION

Figure 1C:
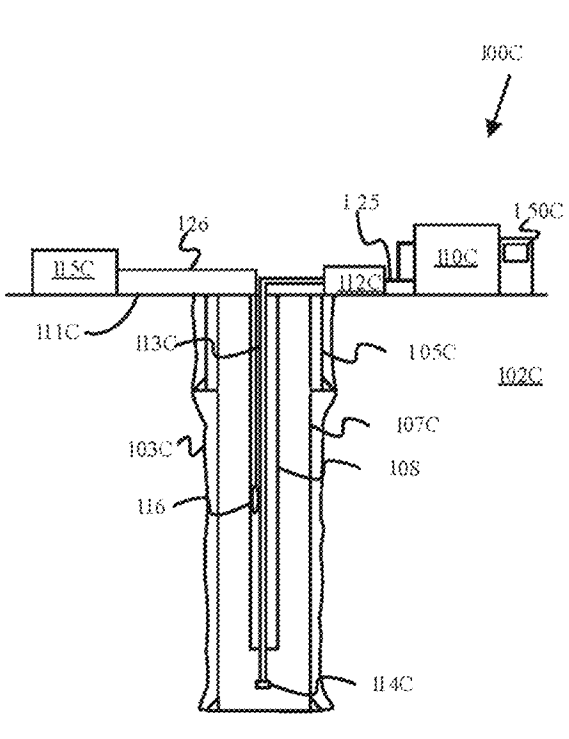
FIG. 1C illustrates an elevation view of a wireline system having fiber optic distributed sensing according to one or more embodiments disclosed herein.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

INTRODUCTION

Careful analysis of distributed sensing data may allow engineers and geoscientists to better understand the behavior of reservoir rock, fluids, and pressure systems to give quantitative values for effective management of hydrocarbon production. This analysis relies on the ability to sample strain and temperature values along the entire borehole trajectory accurately with fine sampling and space and time.

However, current data processing methods do not provide effective data use because the high-resolution measurements generate extremely large data volumes in a short period of time. A few days of data for a typical hydraulic fracturing monitoring task can easily be several tens of terabytes in size. Permanent fiber installations can be used to repeat measurements over time to assess changes in the reservoir or to detect fluid flow rates and compositions. When oil and gas production lasts for a period of years, the problem may be exacerbated. Therefore, effective data analysis must be fast, and ideally will be able to reduce data volumes.

Additional challenges arise because the data may depend on multiple physical processes such as fluid flow, pressure changes, and fracture mechanics. Different processes may also depend on different material properties and on physical structures (e.g., pipes or fracture geometries) of different size and time scales. For example, consider the case of a fiber optic cable permanently installed in the cement layer outside a well subject to hydraulic fracturing. Common methods create several clusters of perforations in the casing pipe with the goal of generating, ideally, equivalent fracture systems from each. An important application of distributed sensing systems, such as distributed acoustic sensing (DAS), in this context is to attempt to measure the uniformity of the newly formed fracture systems. Once fractures begin to form, they will expand and propagate further into the rock formation over a period of several hours. Fluids are injected into the well to increase pressure and generate fractures, and solid particles (proppant) are also pumped into the well to flow into fractures and hold them open to enhance flow of oil or gas. Fluid and proppant flow can change over intervals on the order of minutes or seconds. In addition, the proppant flow rate often is increased in discrete steps. Thus at least some fluid flow behaviors will change on very short time scales, noting also the fracturing will sometimes propagate episodically in brief bursts.

These complex, multiscale (in space and time) physical systems may lead to another important challenge in data analysis: the measurements from the distributed sensing system are a composite of all the processes taking place in the location of the fiber, but in many cases only a subset of processes affected by a subset of spatiotemporal time scales are important for the task at hand. The data processing scheme may be more effective if it includes a tool that can extract the relevant data features for that task. These engineered features may then be well-suited for use in machine learning (ML) techniques to map them from the feature domain to output quantities providing feedback to guide the engineering tasks (e.g., hydraulic fracture operation designs, hydrocarbon production management, etc.).

In part because the adoption of the distributed sensing technology has accelerated rapidly in recent years, development of methods for extracting useful information from these large datasets is also in its initial stages. As noted above, the application of very low frequency analysis of DAS data for characterizing hydraulic fracture systems was introduced only several years ago. Analysis tends to rely on qualitative descriptions and a couple of data features, namely the time and position on the fiber optic cable where a fracture intersects a monitoring well.

The status of technology development for routine utilization of distributed sensing data to guide hydraulic fracturing programs and hydrocarbon production is therefore rather limited and can be summarized as follows: 1) Some common workflows apply filters or standard measures to try to generate features on signals from individual sensor locations one at a time; and 2) There are some initial developments in formulation of ML algorithms for applying distributed sensing to tasks associated with hydraulic fracturing or fluid flow monitoring.

A rigorous and effective approach to feature engineering for ML algorithms for these tasks that correctly considers both the spatial and temporal signal structures, and the differing spatial and temporal scales of physical phenomena generated fiber signal for relevant applications is not currently available.

Distributed sensing systems may collect densely sampled data measurements of strain and temperature along a fiber optic cable positioned within a wellbore. The collected data measurements can provide important constraints on fracture formation or multiphase fluid flow. Analysis of these data measurements is best done simultaneously to consider both the spatial and temporal variation of the complex physical processes taking place as well as their different physical scales. However, most processing schemes currently used only operate on individual sensor channel signals and the results do not incorporate spatial dependence. Embodiments of the system and method presented herein present a complete processing scheme that includes a method for feature engineering that extracts signals reflecting both spatial and temporal properties of the data, wherein the resulting features are sent to machine learning tools that use these features to generate diagnostics allowing wellbore operators to optimize field operations.

Distributed sensing systems play a vital role in the development and production of hydrocarbon resources by recording mechanical and temperature changes in the subsurface with high spatial and temporal resolution. The sensing architecture relies, in some embodiments, on a fiber optic cable through which a laser pulse is transmitted from an interrogator, and back-scattered energy is analyzed by the interrogator to quantify changes in strain or temperature. Measurement technologies routinely available include distributed acoustic sensing (DAS), distributed strain sensing (DSS) and distributed temperature sensing (DTS). Spatial and temporal sampling vary depending on the specific application, but typical values are 1 min. and 0.001 sec., for example. Advances in related technologies are likely to continue to improve spatial resolution for hydrocarbon production tasks.

In some embodiments, the fiber optic cable may be installed permanently outside a well casing, providing the opportunity to sample borehole conditions at any time during the life of the well. The resulting data may provide insights into fluid flow regimes. The fiber optic cable may be positioned along an entire length of the wellbore, which provides a critical advantage over data from a sparse set of individual instruments, such as, e.g., flow meters, that cannot thoroughly provide both spatial and temporal variations associated with fluid behaviors. Distributed sensing systems such as distributed acoustic sensing (DAS), distributed strain sensing (DSS) and distributed temperature sensing (DTS) data may also be acquired with fiber optic cables installed temporarily via a retrievable wireline or an inexpensive disposable fiber. These installations are well-suited for monitoring hydraulic fracturing programs and are utilized routinely to assess the effectiveness of the design and execution of fracturing. For example, low frequency DAS data detects the mechanical deformation of the reservoir medium around a well equipped with a fiber optic cable, and both DAS and DTS systems help constrain the uniformity of fracture response with position in a stage. The development of more quantitative methods to infer fracture flow and mechanical properties is beginning also and will continue to progress. The datasets are exceptionally large because of the high-resolution spatiotemporal sampling and because they are in many cases measured continuously.

The exceptionally large datasets create a significant challenge in analysis since large data volumes require major computational resources. In addition, resulting measurements and analyses should be provided in a real time or near real time approach to guide decisions optimizing hydrocarbon production or hydraulic fracturing procedures. Machine learning (ML) algorithms provide an option for solving problems analyzing exceptionally large data sets, but may function more quickly with smaller data volumes. Further, embodiments of the methods provided herein may be more effective if input measures are well designed, a process referred to herein as feature engineering. Provided herein are embodiments of data that are preprocessed to extract measures that are closely related to phenomena of interest of a system and method that both reduces distributed sensing data volumes and identifies data features that allow rapid and reliable application of ML and other algorithms to guide decision making in the development of hydrocarbon reservoirs.

Embodiments presented provide a solution that receive complex, densely sampled amounts of DAS, DSS or DTS data and computes a small set of representative signals, referred to hereafter as "modes," that decompose the complex, densely sampled data into a smaller set of model signals that quantify the behavior of the physical system on different scales in space and time. Embodiments of the method are data-driven, and generated quantities include a measure of variation of signal strength with distance along the fiber optic cable and frequency parameters that quantify how rapidly the signal varies in time as well as its growth or decay rate. The result is therefore a relatively fast extraction of physically meaningful features that provide greater insight than the complete dataset and in turn facilitate further analysis with ML or other algorithms. Data analysis may provide measures that can be used for any wellbore application utilizing distributed sensing in any stage of reservoir development, and reducing data volumes enable more rapid distribution of the analyzed data. Some embodiments of the method may also be applied to any sensor network, such as sensor arrays, seismometers or tilt meters.

Discussion of Some Embodiments

Figure 1B:
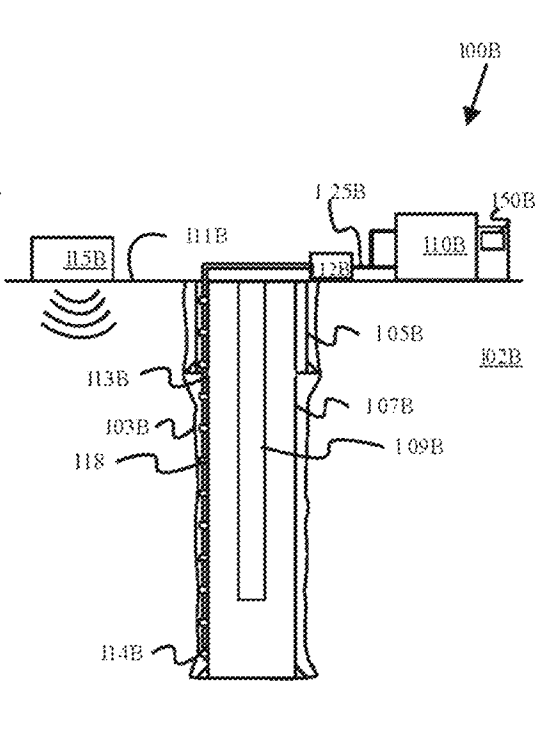
FIG. 1B illustrates an elevation view of a well system having a fiber optic cable fixed to the outside of the production casing of a cased borehole for distributed sensing according to one or more embodiments disclosed herein.
Figure 1A:
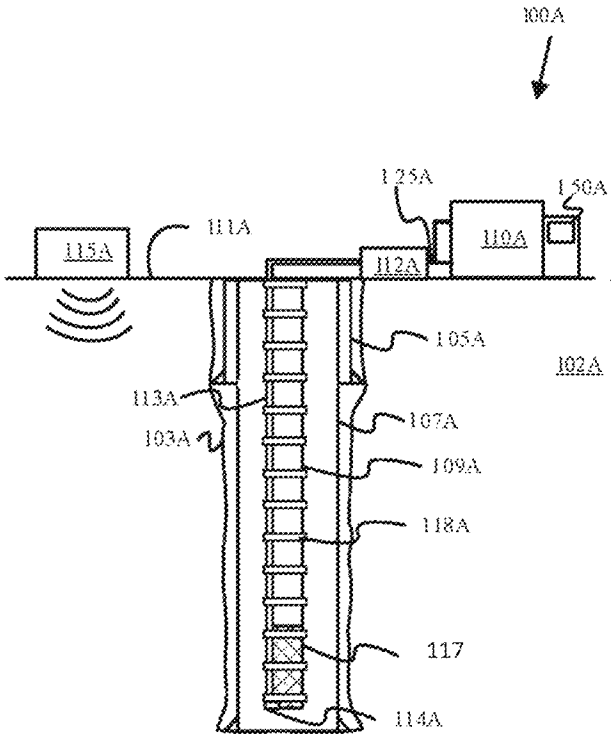
FIG. 1A illustrates an elevation view of a well system having a fiber optic cable fixed to the outside of the production tubing in a cased borehole for distributed sensing according to one or more embodiments disclosed herein.

FIG. 1A illustrates an elevation view of a well system having a fiber optic cable fixed to the outside of the production tubing in a cased borehole for distributed sensing, according to some embodiments. A distributed sensing system 100A, which in some embodiments may be a Distributed Acoustics System (DAS) system, includes a fiber optic cable 113A that can be fixed to the outer perimeter of tubing 109A. Relative to the position of the fiber optic cable 113A, fixing the fiber optic cable 113A to the outer perimeter of the tubing 109A can increase the sensitivity of data measurements to changes in the annular region between production casing 107A and the tubing 109A. Cross-coupling protectors such as a cross-coupling protector 118A can be used to fix the fiber optic cable 113A to the tubing 109A. In addition, a tubing tail 117 can also be fixed to the fiber optic cable 113A and extend below the bottom of the tubing 109A. Seismic energy source 115A on an earth surface 111A may transit electric pulses directly into the subterranean formation 102A.

FIG. 1B illustrates an elevation view of a well system having a fiber optic cable fixed to the outside of the production casing of a cased borehole for distributed sensing, according to some embodiments. A distributed sensing system 100B, includes a fiber optic cable 113B that can be fixed to the outer perimeter of the production casing 107B. Relative to the positions of the fiber optic cable 113A in FIG. 1A, fixing the fiber optic cable 113B to the outer perimeter of the production casing 107B can increase the sensitivity of data measurements to changes in the formation. Cross-coupling protectors such as a cross-coupling protector 118B can be used to fix the fiber optic cable 113B to the outer perimeter of the production casing 107B.

FIG. 1C illustrates an elevation view of a wireline system having a distributed sensing system 100C, according to some embodiments. A borehole 103C in the subterranean formation 102C includes the distributed sensing system 100C, which in some embodiments may be a DAS system, that can detect seismic signals and/or seismic disturbances generated by a wireline-conveyed energy source 126 downhole. A seismic source 115C on an earth surface 111C may transmit electrical pulses through a wire 126 downhole to stimulate the wireline-conveyed energy source 116. The borehole 103C can be a completion well (i.e., a well ready for production or injection following a drilling process) having a surface casing 105C, a production casing 107C inside the surface casing 105C, and a wireline 108 inside the production casing 107C. In some embodiments, the wireline 108 can be replaced by another conveyance, e.g., a casing string, production string, tubing, coiled tubing, work string, slickline, or the like. The distributed sensing system 100C includes a fiber optic cable 113C in the wireline 108 and a signal acquisition system 112C that includes an interrogator.

In some embodiments, the interrogator in the signal acquisition system 112C can be directly coupled to the fiber optic cable 113C. Alternatively, the interrogator may be coupled to a fiber stretcher module in the signal acquisition system 112C, wherein the fiber stretcher module is coupled to the fiber optic cable 113C. The signal acquisition system 112C can receive measurement values taken and/or transmitted along the length of the fiber optic cable 113C. In addition, the signal acquisition system 112*c* can receive measurement values from a bottomhole gauge carrier 114C that can transmit measurements through the fiber optic cable 113C. In some embodiments, the bottomhole gauge carrier 114C can include a pressure temperature gauge and can be inside of, or replaced by, a wireline scanning tool.

Measurement values transmitted through the fiber optic cable 113C can be sent to the signal acquisition system 112C. The interrogator of the signal acquisition system 112C may be electrically connected to a digitizer to convert optically-transmitted measurements into digitized measurements. A computing device 110C can collect the electrically-transmitted measurements from the signal acquisition system 112C using a connector 125C. The computing device may have one or more processors and a memory device to analyze the measurements and graphically represent analysis results on a display device 150C. In addition, the computing device 110C can communicate with components attached to the fiber optic cable 113C. For example, the computing device 110C can send control signals to the bottomhole gauge carrier 114C to modify gauge measurement parameters. Additionally, in some embodiments, at least one processor and memory device can be located downhole for the same purposes. With the fiber optic cable 113C positioned inside a portion of the borehole 103C, the signal acquisition system 112C can obtain information associated with the subterranean formation 102C based on seismic/acoustic disturbances (e.g., seismic disturbances caused by the seismic source 115C).

Figure 1D:
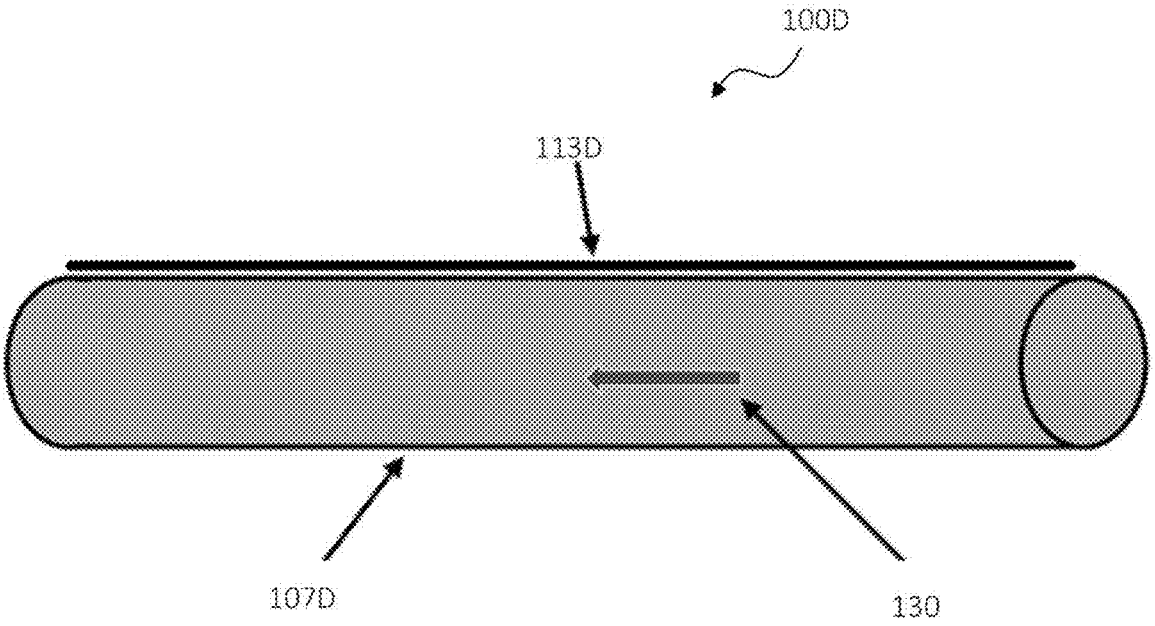
FIG. 1D illustrates one example of a distributed sensing system according to one or more embodiments disclosed herein.

FIG. 1D illustrates another example of a distributed sensing system 100D according to one or more embodiments disclosed herein. Fiber optic cable 113D may be coupled outside of production casing 107D. In some embodiments, the fiber optic cable 113D may be positioned within a flow path 130 of multiphase fluid, such as oil, gas, water, and/or a combination thereof, flowing outside of the production casing 107D. In this embodiment, the fiber optic cable 113D may be positioned between the production casing 107D and a surface casing such as surface casing 105A-C. In other embodiments, the fiber optic cable 113D may be positioned outside of the surface casing 105A-C.

Distributed fiber optic sensing systems measure light signals from a laser pulse transmitted into the fiber optic cable 113D by an interrogator device. Back-scattered light from that pulse is sampled by the interrogator using one of several techniques that in turn provide measurements of mechanical or temperature changes in the medium in which the fiber is emplaced. The temperature of fluids pumped down a well from the surface may be different temperature from that of in situ fluids in the subsurface, with the difference increasing with depth. Detection of anomalous temperature values can thus be used as a tool to gain insights into the presence or absence of hydrocarbon reservoir fluids within the borehole, which may also helps guide strategies for hydrocarbon production.

Initial use of distributed sensing systems, such as DAS applications included both vertical seismic profiling (VSP) and monitoring of hydraulic fracturing activities. VSP experiments generate seismic waves at the Earth's surface and record waves propagating into the subsurface to infer properties of rock layers, including hydrocarbon reservoirs. Traditional VSP data acquisition recorded signals on a relatively small number of individual sensors (geophones); while this set of sensors can be moved within the borehole, this may lead to long acquisition times, since the surface source of waves must be repeated for each depth range. In contrast, the fiber optic cable may be located along the entire length of the borehole, accelerating data acquisition and reducing costs. The same motivations apply for the monitoring of seismic waves generated in hydraulic fracturing experiments. While VSP experiments use an artificial active source of seismic waves which is controlled by the data acquisition team, hydraulic fracturing monitoring commonly relies on passive using signals generated naturally in the subsurface by the formation of hydraulic fractures in the rock medium around the borehole. These weak signals are generated by shear motion on naturally occurring surfaces around the developing hydraulic fracture system and are called micro seismic events. Data processing schemes estimating the location and fracture processes of these events provide important insights to guide fracture engineers.

The DAS systems, including interrogator and fiber optic cable, in early applications in a wellbore, recorded data with a low signal-to-noise ratio (SNR) compared to the geophones. For this reason, the early DAS systems were limited in their ability to detect the weak seismic signals, thereby reducing their effectiveness in characterizing assessing the response of hydraulic fracture programs. However, several advances have taken place in the last several years to accelerate the routine adoption of DAS data. First, improvements in both interrogators and fiber optic cable technologies have improved the SNR in recorded datasets, creating data quality comparable to traditional geophone data. Furthermore, the DAS system records data with a far greater frequency bandwidth than geophone systems, ranging from around 0.001 Hz to about 10,000 Hz, for example. Micro seismic signals have frequency content around 100 to 200 Hz, but it was discovered that analysis of data at frequencies less than 1 Hz provided significant additional insights. Specifically, the low frequency DAS measures measure deformation of the rock formation caused by a developing hydraulic fracture system, including a direct detection of when and where a fracture system intersects a monitor well with a DAS fiber optic cable. The timing of the intersection quantifies the speed of propagation of the hydraulic fracture system in the subsurface, while the position shows its orientation. These are direct measures of the hydraulic fracture system responsible for movement of hydrocarbons in the reservoir layer, in contrast to the indirect insights provided by micro seismic event analysis. As a result, DAS has recently been applied in the production of oil and gas from unconventional reservoirs where hydraulic fracturing is an essential part of reservoir development.

DSS extracts different measures of the laser signal generated by the interrogator that provides estimates of material deformation, strain, over longer time periods such as days or months where DAS is less effective. Typical implementations measure strain with lower SNR than DAS and the application of low frequency DAS has been commonly used for characterization of fracturing stages lasting several hours. However, there are important potential applications for DSS in the petroleum industry, including long term monitoring of deformation associated with both hydrocarbon production and carbon dioxide geosequestration, where waste carbon dioxide is injected into depleted petroleum reservoirs. More recent DSS technologies offer promise of improved spatial resolution and SNR that may provide important contributions to fracturing applications.

Distributed sensing utilizing fiber optic cables has become an important part of many applications for the petroleum industry. DTS measures temperature fluctuations that can be related to production of hydrocarbons. DAS measures strain (extension, shortening along the fiber optic cable) caused by mechanical deformation; it can detect high frequency seismic waves or low frequency, quasi-static deformation associated with development of hydraulic fracture systems. Vibrations and oscillations associated with fluid flow in boreholes can also be detected. DSS measures longer term strain and can be applied to carbon dioxide sequestration monitoring and other tasks.

Advances in technology leading to faster, more accurate analysis providing quantitative insights into fracturing or fluid flow, for example, may provide significant economic value. In many tasks where real time decisions must be made, such as the implementation and revision of hydraulic fracturing designs, computational speed is especially important, especially in systems receiving large volumes of data generated by distributed sensing systems.

Figure 2:
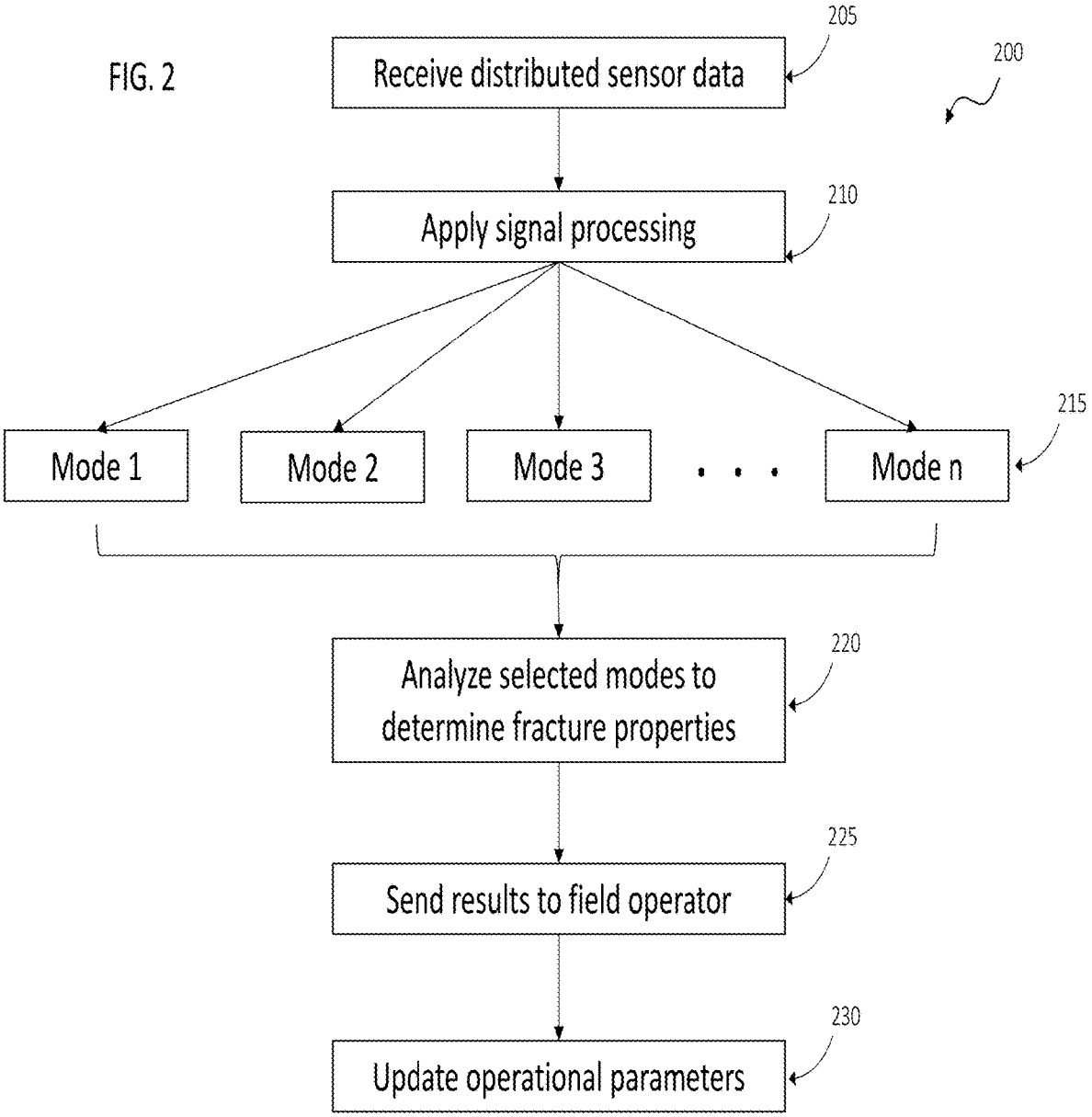
FIG. 2 illustrates one embodiment of a method for processing data from a distributed sensing system such as those illustrated in FIG. 1A through 1D according to one or more embodiments disclosed herein.
Figure 4:
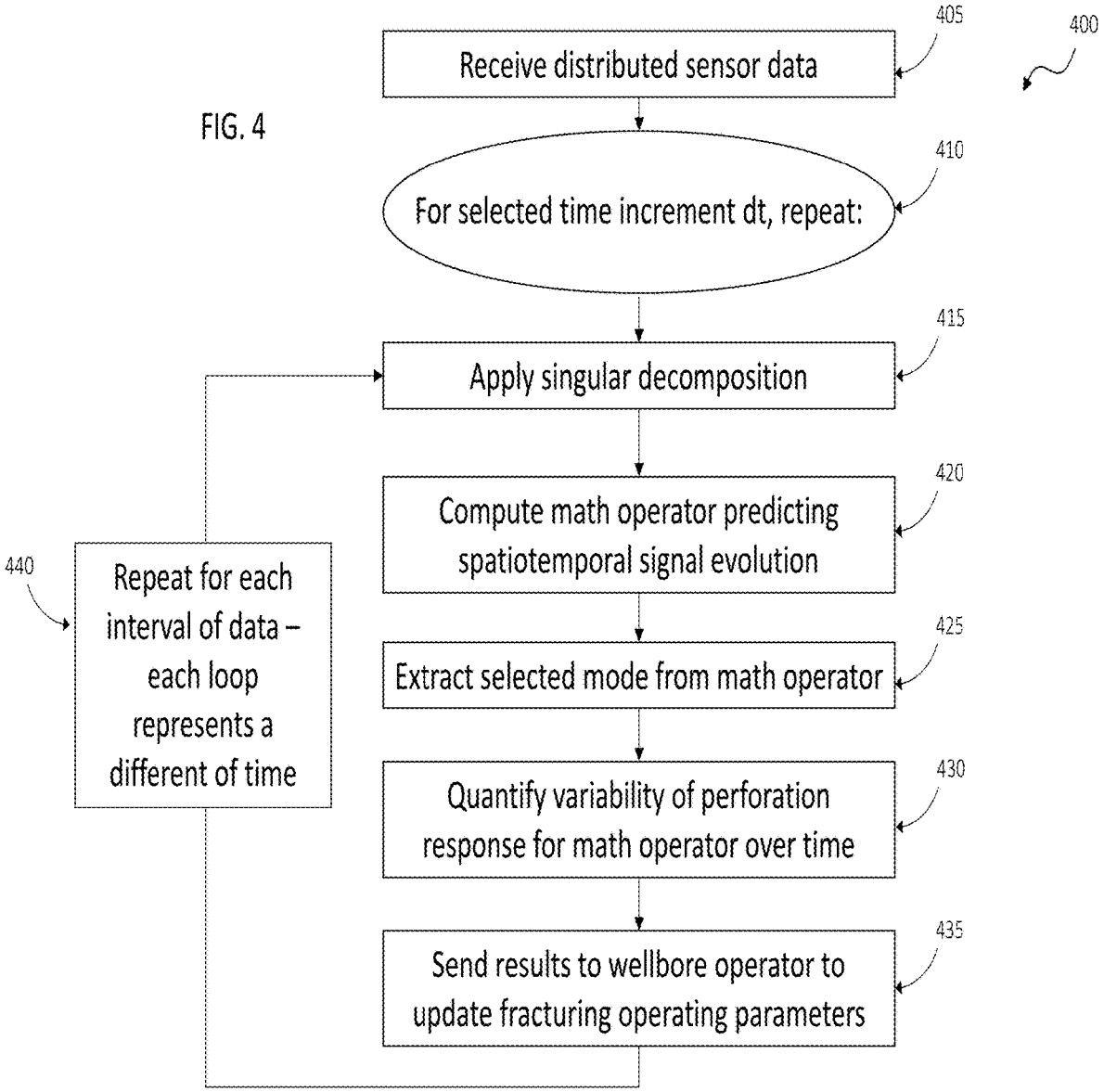
FIG. 4 illustrates one embodiment of a data analysis method according to one or more embodiments disclosed herein.

Referring now to FIG. 2, there is shown a method 200 for processing distributed sensing data such as data that may be received from a plurality of sensors or sensor arrays which may comprise distributed sensing systems such as system 100A, or in other embodiments, DAS, DTS and/or DSS systems. A processor may extract features that are a unique combination of fiber signals with different time variation (or frequencies) and unique dependence on distance along the fiber, the resulting extracted features referred to as engineered features. These engineered features are transmitted to a processing system that applies ML algorithms or other data schemes to generate quantitative measures of hydraulic fracturing performance or multiphase flow during production. In step 205, a processor receives measurement data from a distributed sensing system having sensors distributed along different depths of a wellbore. In a step 210, the processor is configured to perform signal processing of the received data to output a number of modes. In some embodiments, the signal processing may be a data decomposition, and this embodiment, is a dynamic mode decomposition (DMD) of the received data. At step 215, each mode is defined to include a small set or subset of the data that quantifies behavior in the wellbore on a different combination of locations in the wellbore and timing of the measurements. In some applications, the behavior may include behavior of a fluid in the wellbore. In other embodiments, the behavior may include hydraulic fracturing operation and/or a flow of fluid. Each mode may relate to a different physical process or wellbore property. At step 220, the processor may analyze one or more selected modes to determine fracture properties of the wellbore. At step 225, the results of the analysis of the one or more selected modes may be sent to a wellbore operator to update operational parameters at step 230. Examples of operational parameters that may be adjusted in step 230 include injection rate of fluid, duration of fracture stages, timing of proppant injection, etc. Rapid delivery of these measures will allow wellbore operators to make better decisions to optimize reservoir development and economic benefits. As the data are received, feature engineering is applied to a sliding time window with a predefined length of time. The sequence of operations for one embodiment of the algorithm that may be applied to the data is illustrated in FIG. 4. Some embodiments may perform fewer than all of the operations shown in FIG. 2. For example, some embodiments may merely perform steps 205 and 210 to produce the modes, whereas other embodiments may perform all operations shown in FIG. 2.

Figure 3:
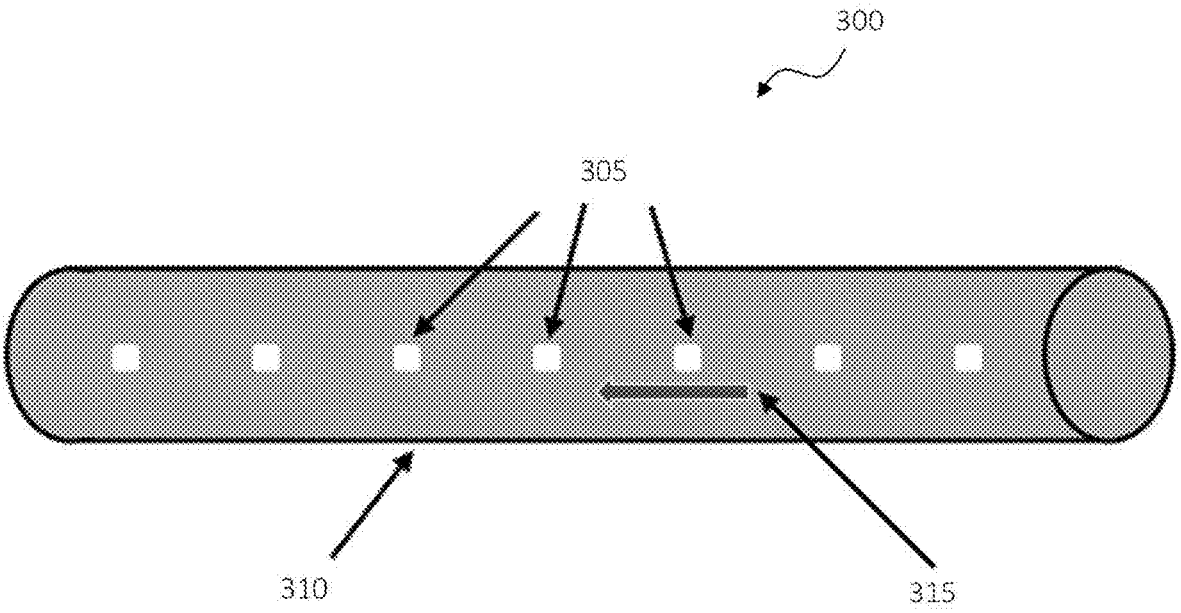
FIG. 3 illustrates another embodiment of a distributed sensing system according to one or more embodiments disclosed herein.

FIG. 3 illustrates another embodiment of a distributed sensing system 300 which may be used within a wellbore. The distributed sensing system 300 may include an array of sensors 305 which may be positioned along a production casing 310 and may be positioned within a flow path of multiphase fluid 315. The array of sensors 305 may be used instead of sensors positioned along a fiber optic cable. In some embodiments, the fiber optic cable may be located within the wellbore, and may sometimes be a simple fiber. In other embodiments, the fiber optic cable may be positioned between the production casing 310 and the tubing, such as, e.g. tubing 109B.

Embodiments of the method and systems presented herein are shown with distributed sensing systems such as sensors along a fiber optic cable or alternatively an array of sensors, but the systems and methods presented herein may also be used with discrete measuring devices of any type.

Some embodiments of the distributed sensing system 300 may include a graphical user interface consistent with other acquisition and processing software currently used, and may provide a report which may be delivered to customers along with other diagnostics and analytic information.

FIG. 4 illustrates another embodiment of a method of data decomposition applied to measure uniformity of fracture generation within a perforation cluster during a stage of hydraulic fracturing. The data is measured by a distributed sensing system, in one embodiment, having a plurality of sensors positioned along a fiber optic cable cemented outside outer casing of the well subjected to hydraulic fracturing. One set of data may be received from DAS hardware, having values for a subset corresponding to a specified time duration. The data is input to two keys steps, steps 415 and 420, that are part of signal processing, which is in this embodiment is a method of dynamic mode decomposition (DMD). The method 400 illustrates one example of a singular value decomposition of an array of data (step 415), followed by computation of an operator (step 420) that predicts the evolution of the data with increasing time and extracts the modes comprising the data.

In step 405, data is received from a distributed sensing system. In step 410, as the data is received, feature engineering (e.g., data preprocessed to extract measures that are closely related to an application or behavior of interest) is applied to a sliding time window, delta t (dt), with a predefined length of time. This value of dt will depend on which wellbore application or behavior is of interest, applying larger values for lower frequency phenomena. The increment in the start time of this time window may also be defined according to the behavior or application of interest. For example, processing might utilize data in a time window with length of 10 sec for time points starting at increments of dt=1 sec. For each time window, the modified DMD algorithm may be applied and repeated until all of the steps 415 through 435 are completed for each data set. At a first step 415 of the repeated steps, a singular value decomposition (SVD) may be applied to a data array to output intermediate results describing the data array. SVD results may include the singular values and corresponding left and right matrices U and V, respectively, which are the key quantities for estimation of a mathematical operator predicting a set of signals (modes) depending on position on the fiber and on time that correspond to unique frequency values. At step 420, a mathematical operator is computed for predicting spatiotemporal signal evolution of the data and generate a number of modes. Each mode may be associated with a parameter measuring the growth or decay with time of the mode. Each mode may represent part of the temperature or strain variation of the measured system with a unique spatiotemporal behavior. Because the mode signals may be in general complex-valued functions, one challenge is how to best extract simple values that can be applied in subsequent analysis. Steps 415 and 420 combined represent customization of signal processing such as dynamic mode decomposition, in this embodiment, to extract measures that are physically meaningful and applicable for ML tasks. These steps provide for effective usage in wellbore environments where the fiber data includes a combination of DTS or DAS, different values with distinct numerical ranges.

At step 425, using the mathematical operator, a selected mode of the number of modes is extracted and used as input to subsequent analysis steps, which may, in some embodiments, be a ML implementation that derives quantitative values that can in turn be utilized to guide field operations. A key aspect of this approach is that approximating the original data using a subset of modes may greatly reduce the data volume required for subsequent operations. As a result, operations requiring transmission of data may benefit from accelerated computations.

At step 430, a behavior in the wellbore is quantified based on the selected mode. In some embodiments, the behavior in the wellbore includes temperature variation in the wellbore, strain variation in the wellbore, or pressure in the wellbore. In the illustrated example, the behavior is perforation response in the wellbore. Once the behavior is quantified, at a step 435, the results are sent to an oilfield or wellbore operator to update operational parameters, such as, e.g., fracturing parameters, within the wellbore. At a step 440, the loop of steps 415 through 435 are repeated for each interval of data, incremented by dt, for each different segment of time.

While the method 400 may be applied to comparable problems such as the detection of flow patterns and currents in the ocean, the example embodiment presented in FIG. 4 is applied to optimize results for detection of hydraulic fracturing signals. Once modes are identified, one mode is extracted and utilized to quantify the mechanical strain associated with fracturing at each perforation. This in turn may be utilized by the wellbore operator to revise the hydraulic fracturing implementation to improve response if needed.

FIGS. 5A through 5C illustrate an example of input data (FIG. 5A) and the extracted signal throughout the fracture stage (5C). FIG. 5A illustrates a time versus measured depth and a fracture range. FIG. 5B illustrates a DAS data example acquired in fiber cemented outside fracture treatment well, illustrating measurements taken over time, including pressure, sand/slurry at a top of the wellbore, fluid rate, and borehole properties measure at a bottom of the wellbore.

Figure 6A:
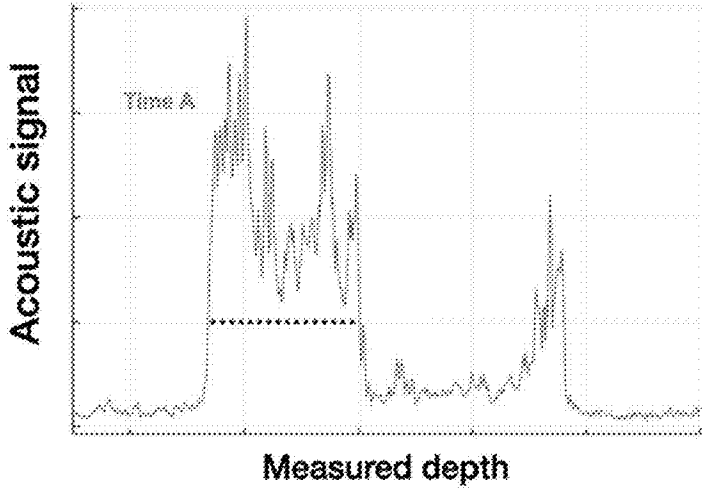
FIG. 6A-6B illustrate one example of data compared using extracted mode features according to one or more embodiments disclosed herein.
Figure 6B:
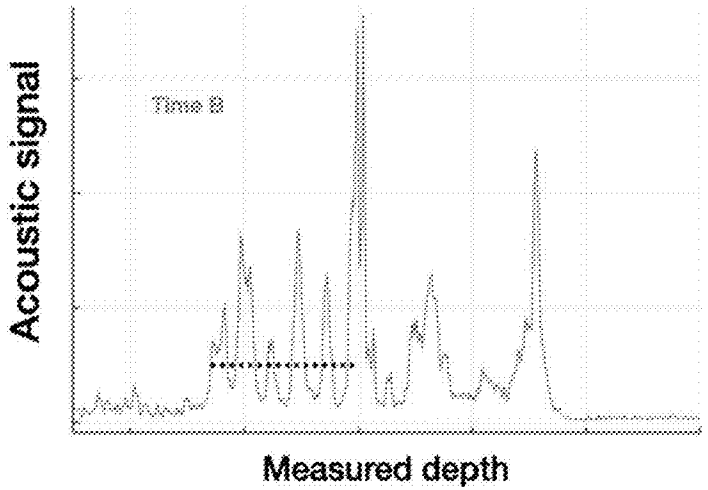

FIG. 5C illustrates a depth range where new fractures are intended to be generated. White arrows also mark an extracted signal showing where fractures from an earlier stage are unintentionally reactivated. The bars marked Time A and Time B mark two time points for which details are shown in FIGS. 6A and 6B. Compared to the original data, the engineered features make it straightforward to identify the change in fracture response from an approximately uniform signal from times about 4000 to 4500 sec, followed by a subsequent change to a highly nonuniform response where two perforation clusters are responsible for most of the fracture activity.

FIGS. 6A and 6B illustrate comparisons of the acoustic signal (engineered features) in extracted mode features, shown as solid lines, to and perforation cluster locations (represented as black dots) marking desired fracture locations. The curves are displayed for the times A and B marked in FIG. 5C. The peaks represent strength of fracturing at Time A and Time B. During an earlier time period, Time A, the acoustic signal is mostly isolated to the desired range of depth with fairly uniform response at each cluster, although there is shown evidence of leakage leading to energy at larger depth. However, by Time B, when the proppant rate increases, fracturing is much less uniform and signal level is much higher outside the desired range indicating plug failures. An ML algorithm may be used to identify a nonuniform response automatically to signal a wellbore engineer to adjust fracturing procedures and to address potential problems.

Figure 7A:
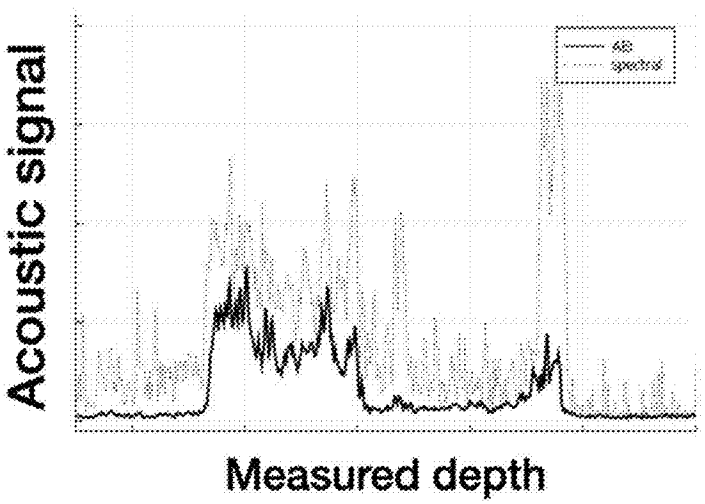
FIG. 7A-7B illustrate another example of data analyzed according to one or more embodiments disclosed herein.
Figure 7B:
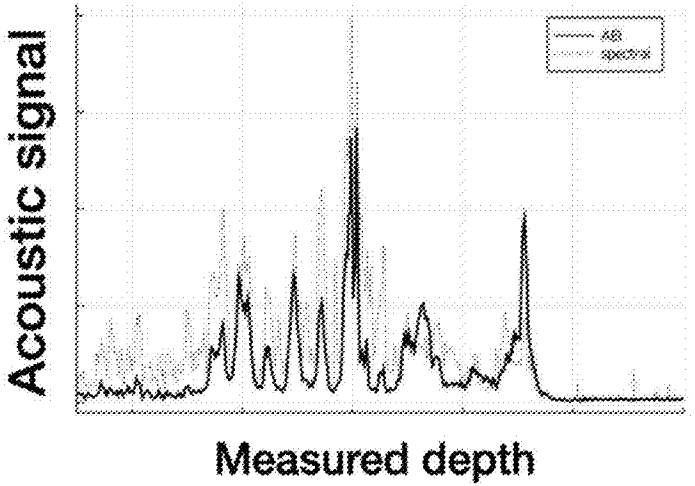

FIGS. 7A and 7B compare curves showing an extracted mode, comparing acoustic signals, labelled as an acoustic energy indicator (AEI), to the simple alternative of simply measuring signal at each sensor location. FIG. 7B illustrates a much broader, poorly defined set of large values compared to the AEI, which sharply defines the range of positions with sharp signals. The broader, more diffuse patterns are much less effective in showing fracture formation because the amplitudes are measured only on individual sensor channels and do not take into spatial variability.

Figure 8:
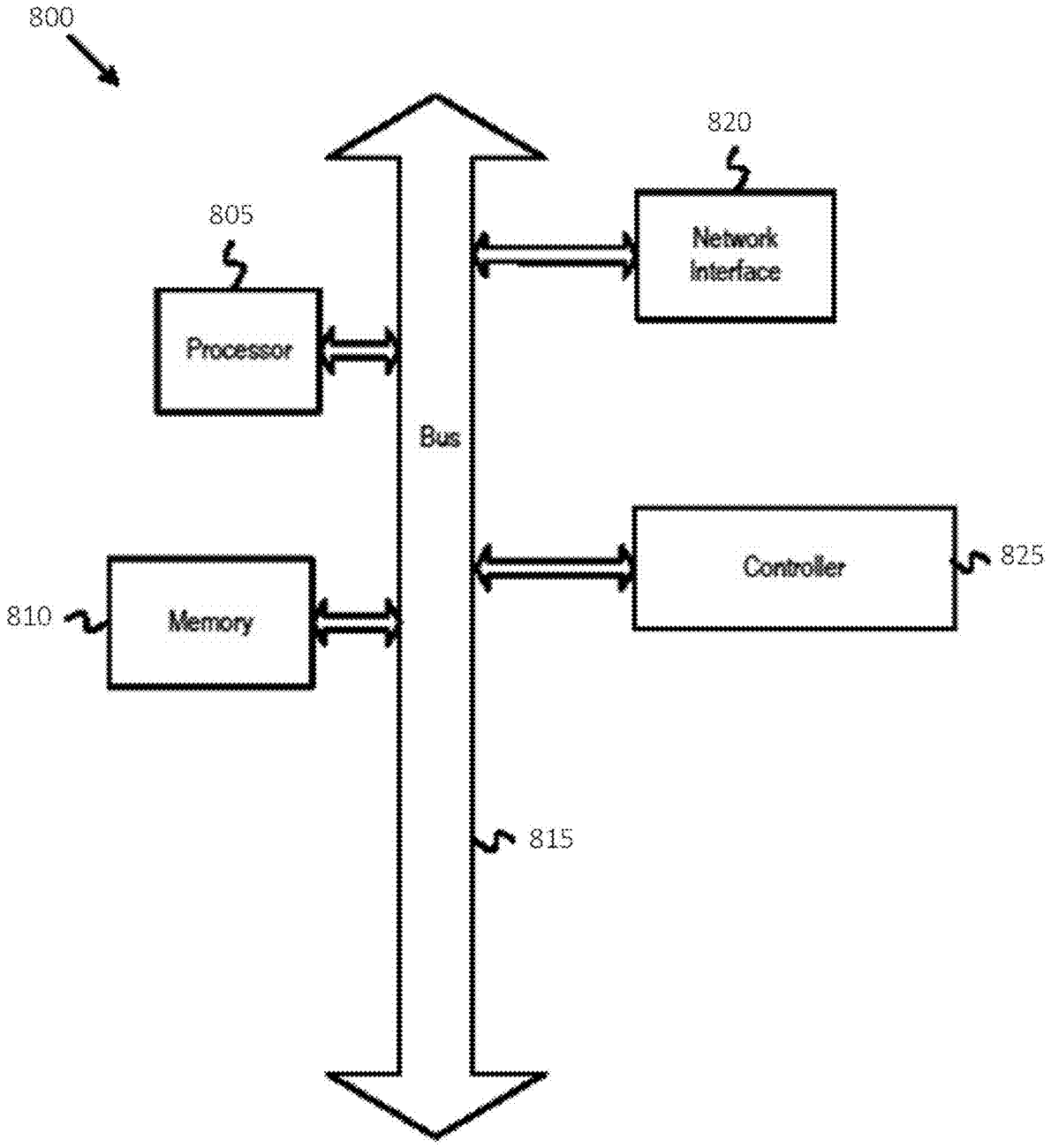
FIG. 8 illustrates an example of non-transitory computer system that may be used with the fiber-optic sensing and data processing systems of FIG. 1A through FIG. 7B designed and manufactured according to one or more embodiments disclosed herein.

FIG. 8 illustrates an example computer, according to some embodiments. In particular, FIG. 8 illustrates a computer 800 that includes a processor 805 (possibly including multiple processors, multiple cores, multiple nodes, and/or implementing multi-threading, etc. The processor 805 may be stored on a non-transitory computer readable medium. The computer 800 includes a memory 810. The memory 810 may be system memory or any one or more of the above already described possible realizations of machine-readable media. The computer 800 also includes a bus 815 and a network interface 820.

The computer 800 also includes a controller 825. The controller 825 may perform one or more of the functionalities described herein. In some embodiments, the controller 825 may be coupled with a wellbore system and with a distributed sensing system within the wellbore. The controller 825 may be configured to receive data from a plurality of sensors positioned along various depths of the wellbore. In some embodiments the sensors may be incorporated in a fiber optic cable positioned adjacent one or more casings in the wellbore, either within a production casing, between a production and outer casing, or external the outer casing. Dynamic mode decomposition may be applied to the data for a determined amount of modes. The data may then be analyzed to determine fracture properties within the wellbore. The data analysis results may then be sent to an operator for the wellbore and operational properties of the wellbore may be adjusted. Any one of the previously described functionalities may be partially (or entirely) implemented in hardware and/or on the processor 805. For example, the functionality may be implemented with an application specific integrated circuit, in logic implemented in the processor 805, in a co-processor on a peripheral device or card, etc. Further, realizations may include fewer or additional components not illustrated in FIG. 8 (e.g., video cards, audio cards, additional network interfaces, peripheral devices, etc.). The processor may have a memory and may have one or more machine learning (ML) or deterministic algorithms stored thereon, which may be used for data analysis. The processor 805 and the network interface 820 may be coupled to the bus 815. Although illustrated as being coupled to the bus 815, the memory 810 may in some embodiments be coupled to the processor 805.

An analysis sequence like that outlined for the previous case may be applied when the monitor well equipped with the fiber optic cable is located at some distance from the treatment well subjected to hydraulic fracturing. While the general steps of the methods are the same, the extraction of a mode feature may be optimized for the very low frequency signals indicative of hydraulic fractures approaching the monitor well. Reduction of data volumes can be greater given these low frequencies. The engineered features (modes) can be applied in subsequent ML tools to identify fractures, predict when they will intersect the monitor well and estimate geometry.

Another embodiment follows the same structure as the first case, except that DTS and DAS data are combined for analysis of perforation cluster uniformity. The computation of modes can utilize a data array combining multiple data types, and ML algorithms routinely do so. When both data types are available and required features are engineered, the invention will provide enhanced insight into fracture response.

Fluid motion will induce strain variations that can be detected by DAS, and the signal will have some dependence on the amounts of oil, gas, and water present. In addition, borehole features such as inflow devices, changes in casing diameter or other instrumentation will generate larger amplitude signals that can be detected by DAS. This embodiment applies the feature extraction step to generate modes measuring the spatial and temporal variation of flow-related strain generated along the borehole and at the features noted previously that may induce turbulence and more complex flow phenomena.

The ML algorithm utilized to estimate values such as flow rate or fluid composition using these engineered features will require supplementary training data. For this application, the ML system will be trained on a combination of laboratory and available numerical simulation results comparable to the field setting. The same feature engineering will be applied to the training data for this purpose.

In another embodiment, the quantification of fluid flow may combine modal features extracted from both DAS and DTS data to identify variations in fluid flow. The incorporation of DTS will allow identification of positions along the fiber where larger volumes of formation fluid enter the borehole.

Aspects disclosed herein include:

Aspect A: A method comprising: receiving data of measurements from a distributed sensing system having sensors distributed along different depths of a wellbore formed in a subsurface formation; and performing signal processing of the data to output a number of modes, wherein each mode includes a subset of the data that quantifies behavior of at least one of a fluid in the subsurface formation and a rock in the subsurface formation on a different combination of locations in the wellbore and timing of the measurements.

Aspect B: a system, comprising: a distributed sensing system having sensors distributed along different depths of a wellbore formed in a subsurface formation; a processor; and a non-transitory computer readable medium having instructions stored thereon that are executable by the processor to cause the processor, receive measurements of data from the distributed sensing system; and perform signal processing of the data to output a number of modes, wherein each mode includes a subset of the data that quantifies behavior of at least one of a fluid in the subsurface formation and a rock in the subsurface formation on a different combination of locations in the wellbore and timing of the measurements.

Aspect C: a non-transitory, computer-readable medium having instructions stored thereon that are executable by a processor to perform operations comprising: receiving data of measurements from a distributed sensing system having sensors distributed along different depths of a wellbore formed in a subsurface formation; and performing signal processing of the data to output a number of modes, wherein each mode includes a subset of the data that quantifies behavior of at least one of a fluid in the subsurface formation and a rock in the subsurface formation on a different combination of locations in the wellbore and timing of the measurements.

Aspects A, B, and C may have one or more of the following additional elements in combination:

Element 1: wherein performing signal processing of the data comprises performing data decomposition of the data to output the number of modes;

Element 2: wherein performing data decomposition of the data comprises performing dynamic mode decomposition of the data;

Element 3: wherein the measurement of data comprise a data array, wherein performing the dynamic mode decomposition of the measurements comprises performing a singular value decomposition to the data array to output a number of modes;

Element 4: wherein each mode of the number of modes is associated with at least one of a growth and decay over time of a parameter being measured in the wellbore;

Element 5: wherein the dynamic mode decomposition further includes: computing a mathematical operator that predicts spatiotemporal evolution of the data; extracting, using the mathematical operator, a selected mode of the number of modes; and quantifying, based on the selected mode, the behavior in the wellbore;

Element 6: wherein the subset of the data that quantifies the behavior comprises data that quantifies behavior of a fluid in the wellbore;

Element 7: wherein the behavior in the wellbore includes temperature variation in the wellbore, strain variation in the wellbore, or pressure in the wellbore;

Element 8: further comprising applying a sliding time window having a defined length that is based on a frequency of the measurements;

Element 9: wherein receiving the measurements of data from the distributed sensing system different comprises receiving at least one of strain and temperature;

Element 10: wherein the sensors distributed along different depths of the wellbore are positioned along a fiber optic cable positioned in the wellbore;

Element 11: wherein the instructions that are executable by the processor to cause the processor to perform signal processing of the data comprises performing data decomposition of the data to output the number of modes;

Element 13: wherein the instructions that are executable by the processor to cause the processor to perform data decomposition of the data comprises instructions that are executable by the processor to cause the processor to perform dynamic mode decomposition of the data;

Element 14: wherein performing signal processing of the data comprises performing data decomposition of the data to output the number of modes;

Element 15: wherein performing data decomposition of the data comprises performing dynamic mode decomposition of the data;

Element 16: wherein the data of measurements comprise a data array, wherein performing the dynamic mode decomposition of the data of measurements comprises performing a singular value decomposition to the data array to output a number of modes, wherein each mode of the number of modes is associated with at least one of a growth and decay over time of a parameter being measured in the wellbore; and Element 17: wherein the dynamic mode decomposition further includes: computing a mathematical operator that predicts spatiotemporal evolution of the data; extracting, using the mathematical operator, a selected mode of the number of modes; and quantifying, based on the selected mode, the behavior in the wellbore.

Those skilled in the art to which this application relates will appreciate that other and further additions, deletions, substitutions and modifications may be made to the described embodiments.

What is claimed is:

1. A method comprising:

receiving data of measurements from a distributed sensing system having sensors distributed along different depths of a wellbore formed in a subsurface formation;

performing dynamic mode decomposition of the data to output a number of modes, wherein each mode includes a subset of the data that quantifies behavior of at least one of a fluid in the subsurface formation and a rock in the subsurface formation on a different combination of locations in the wellbore and timing of the measurements, wherein the dynamic mode decomposition is performed simultaneously to consider both spatial and temporal variation of the data during hydraulic fracturing or a production process;

selecting a first mode of the number of modes;

quantifying, based at least in part on the first mode, the behavior in the wellbore; and providing said quantification to a wellbore operator for updating operational parameters to a wellbore operation during hydraulic fracturing or production operations.

2. The method of claim 1, wherein the measurements of data comprise a data array, wherein performing the dynamic mode decomposition of the measurements comprises performing a singular value decomposition to the data array to output the number of modes, wherein each mode of the number of modes is associated with at least one of a growth and decay over time of a parameter being measured in the wellbore.

3. The method of claim 2, wherein the dynamic mode decomposition further includes:

computing a mathematical operator that predicts spatiotemporal evolution of the data, wherein said selecting the first mode of the number of modes comprises extracting, using the mathematical operator, the first mode of the number of modes.

4. The method of claim 1, wherein the subset of the data that quantifies the behavior comprises data that quantifies behavior of a fluid in the wellbore.

5. The method of claim 1, wherein the behavior in the wellbore includes temperature variation in the wellbore, strain variation in the wellbore, or pressure in the wellbore.

6. The method of claim 1, further comprising applying a sliding time window having a defined length that is based on a frequency of the measurements.

7. The method of claim 1, wherein receiving the measurements from the distributed sensing system different comprises receiving at least one of strain and temperature.

8. The method of claim 1, wherein said quantifying the behavior in the wellbore comprises identifying at least one fracture property and wherein the method further comprises modifying at least one of an injection rate, injection pressure, and proppant concentration to control the at least one fracture property.

9. The method of claim 1, wherein said quantifying the behavior in the wellbore comprises identifying at least one multiphase fluid property and wherein the method further comprises modifying at least one of a production rate or an injection rate to control the at least one multiphase fluid property.

10. A system, comprising:

a distributed sensing system having sensors distributed along different depths of a wellbore formed in a subsurface formation;

a processor; and a non-transitory computer readable medium having instructions stored thereon that are executable by the processor to cause the processor, receive measurements of data from the distributed sensing system;

perform dynamic mode decomposition of the data to output a number of modes, wherein each mode includes a subset of the data that quantifies behavior of at least one of a fluid in the subsurface formation and a rock in the subsurface formation on a different combination of locations in the wellbore and timing of the measurements, wherein the dynamic mode decomposition is performed simultaneously to consider both spatial and temporal variation of the data during hydraulic fracturing or a production process; and select a first mode of the number of modes;

quantify, based at least in part on the first mode, the behavior in the wellbore; and provide said quantification to a wellbore operator for updating operational parameters to a wellbore operation during hydraulic fracturing or production operations.

11. The system of claim 10, wherein said instructions to quantify the behavior in the wellbore comprises identifying at least one multiphase fluid property and wherein the instructions further comprise instructions executable by the processor to cause the processor to modify at least one of a production rate or an injection rate to control the at least one multiphase fluid property.

12. The system of claim 10, wherein said instructions to quantify the behavior in the wellbore comprises identifying at least one fracture property and wherein the instructions further comprise instructions executable by the processor to cause the processor to modify at least one of an injection rate, injection pressure, and proppant concentration to control the at least one fracture property.

13. The system of claim 12, wherein the data comprise a data array, wherein performing the dynamic mode decomposition of the data comprises performing a singular value decomposition to the data array to output the number of modes, wherein each mode of the number of modes is associated with at least one of a growth and decay over time of a parameter being measured in the wellbore.

14. The system of claim 13, wherein the dynamic mode decomposition further includes:

computing a mathematical operator that predicts spatiotemporal evolution of the data, wherein said selection of the first mode of the number of modes comprises extracting, using the mathematical operator, the first mode of the number of modes.

15. The system of claim 12, wherein the subset of the data that quantifies the behavior comprises data that quantifies behavior of a fluid in the wellbore and wherein the behavior in the wellbore includes temperature variation in the wellbore, strain variation in the wellbore, or pressure in the wellbore.

16. A non-transitory, computer-readable medium having instructions stored thereon that are executable by a processor to perform operations comprising:

receiving data of measurements from a distributed sensing system having sensors distributed along different depths of a wellbore formed in a subsurface formation;

performing dynamic mode decomposition of the data to output a number of modes, wherein each mode includes a subset of the data that quantifies behavior of at least one of a fluid in the subsurface formation and a rock in the subsurface formation on a different combination of locations in the wellbore and timing of the measurements, wherein the dynamic mode decomposition is performed simultaneously to consider both spatial and temporal variation of the data during hydraulic fracturing or a production process; and selecting a first mode of the number of modes;

quantifying, based at least in part on the first mode, the behavior in the wellbore; and providing said quantification to a wellbore operator for updating operational parameters to a wellbore operation during hydraulic fracturing or production operations.

17. The non-transitory, computer-readable medium of claim 16, wherein the data of measurements comprise a data array, wherein performing the dynamic mode decomposition of the data of measurements comprises performing a singular value decomposition to the data array to output the number of modes, wherein each mode of the number of modes is associated with at least one of a growth and decay over time of a parameter being measured in the wellbore.

18. The non-transitory, computer-readable medium of claim 17, wherein the dynamic mode decomposition further includes:

computing a mathematical operator that predicts spatiotemporal evolution of the data, wherein said selecting the first mode of the number of modes comprises extracting, using the mathematical operator, a selected mode of the number of modes.

19. The non-transitory, computer-readable medium of claim 16, wherein said quantifying the behavior in the wellbore comprises identifying at least one fracture property and wherein the operations further comprise modifying at least one of an injection rate, injection pressure, and proppant concentration to control the at least one fracture property.

20. The non-transitory, computer-readable medium of claim 16, wherein said quantifying the behavior in the wellbore comprises identifying at least one multiphase fluid property and wherein the operations further comprise modifying at least one of a production rate or an injection rate to control the at least one multiphase fluid property.

* * * * *